US006912806B2

(12) United States Patent
Malindretos

(10) Patent No.: US 6,912,806 B2
(45) Date of Patent: Jul. 5, 2005

(54) DEVICE FOR A SMALL ARM

(76) Inventor: Lars Malindretos, Zur Mainbuche 15, D-47804 Krefeld (DE)

( * ) Notice: Subject to any disclaimer, the term of this patent is extended or adjusted under 35 U.S.C. 154(b) by 85 days.

(21) Appl. No.: 10/362,487

(22) PCT Filed: Aug. 16, 2001

(86) PCT No.: PCT/EP01/09451

§ 371 (c)(1),
(2), (4) Date: Feb. 20, 2003

(87) PCT Pub. No.: WO02/16858

PCT Pub. Date: Feb. 28, 2002

(65) Prior Publication Data

US 2003/0167672 A1 Sep. 11, 2003

(30) Foreign Application Priority Data

Aug. 25, 2000 (DE) ..... 100 41 945

(51) Int. Cl.[7] ..... F41A 7/00; F41A 3/00

(52) U.S. Cl. ..... 42/17; 42/18; 42/49.01; 42/50; 89/33.04; 89/128

(58) Field of Search ..... 89/33.04, 128; 42/17, 18, 50, 49.01

(56) References Cited

U.S. PATENT DOCUMENTS 3,505,927 A * 4/1970 Driscoll
4,864,758 A 9/1989 Crossman ..... 42/18
4,867,039 A * 9/1989 Dobbins ..... 42/18
5,027,541 A * 7/1991 Velezis ..... 42/18
5,056,252 A 10/1991 Velezis ..... 42/50
5,452,533 A 9/1995 Bentley ..... 42/17
5,456,153 A 10/1995 Bentley et al. ..... 89/33.02
5,771,620 A * 6/1998 Crawford et al.

* cited by examiner

*Primary Examiner*—Michael J. Carone
*Assistant Examiner*—Lulit Semunegus
(74) *Attorney, Agent, or Firm*—Herbert Dubno; Andrew Wilford

(57) ABSTRACT

The invention relates to a device for feeding cartridges (15) from magazines to small arms, in particular to rifles with a cartridge feed device (3–7, 25–29), which transports the cartridges from a tubular magazine (11) to the barrel (1) by means of a device, in particular a rocker/spoon (3, 25–29). Said device comprises a breech, which receives the cartridges from the cartridge feed device, slides them into the barrel and closes the latter. The rocker/spoon of the cartridge feed device can be removed from the intermediate chamber between the tubular magazine and the lock (13) and an interchangeable cartridge magazine (16) can be inserted in the empty intermediate chamber (21). In a first embodiment, the rocker (3) can be displaced from a front position into a rear position. In a second embodiment, the rocker (3) can be pivoted from an upper, approximately horizontal position into a lower, approximately perpendicular position. In a third embodiment, the rocker (3) is surrounded by a box, which together with the rocker can be removed from the weapon, in a similar manner to the interchangeable magazine.

9 Claims, 4 Drawing Sheets

DEVICE FOR A SMALL ARM

The invention relates to a device for feeding cartridges from a magazine in a small arm, in particular guns with a cartridge-feeding system that shifts cartridges from a tube magazine to the barrel by a device, in particular a carrier, and with a breech that takes the cartridges from the cartridge feeder, slides them into the barrel, and closes the rear end of the barrel.

The slide-action repeater rifles used by United States police are provided with tube magazines and appropriate feed devices, with a magazine capacity of between four and six cartridges. In an emergency, reloading such a gun takes too long, so that the officer, once he has shot all the cartridges from his rifle, resorts to a short arm (automatic or revolver). This historically leads to bad results in a fire fight.

It is known to supply individual barrels of small arms by specifically constructed magazines. A tube magazine of standard design entails a limited fire power and time-consuming reloading. If however switchable detachable magazines are used, the gun has a clumsy shape and is difficult to handle, in particular when being transported or readied for use.

In addition according to the state of the art (U.S. Pat. No. 5,056,252, U.S. Pat. No. 4,864,758, U.S. Pat. No. 5,456,153, and U.S. Pat. No. 5,452,533) it is known to provided a repeating small arm having a tube magazine with a separate detachable box magazine as a retrofit. In this manner, however, the capacity of the tube magazine is reduced.

The solution in the cited prior art, to empty the cartridges out of the tube magazine, and thereafter to feed cartridges to the barrel from a detachable magazine by means of the cartridge feeder, requires numerous modifications and creates a considerable risk of mechanical failure.

In addition the above-cited additional box magazines make handling of the gun at times very dangerous.

It is an object of the invention to construct the cartridge feeder of a small arm having a tube magazine such that the same barrel can be supplied by two different magazines, switching between the two magazines only taking a few seconds while retaining the normal handling as well as the capacity of the gun with its standard magazine.

This object is achieved in that the device, in particular a carrier of the cartridge feeder, can move out of the space between the tube magazine and the latch plate and/or out of the space between the cartridge supply and the receiver and a detachable magazine can be fitted to this space.

The present invention relates to a cartridge feeder for repeating small arms that allows the use of both the standard tube magazine and a separate detachable magazine. The advantages of the system according to the invention is in the optionally increasable loading capacity of the pump-action gun. In addition to about six shells held in the built-in tube magazine one can, if necessary when it is empty, very quickly fit a standard detachable magazine. The handing of the gun without the detachable magazine is the same as before, but there is always the option to use a detachable magazine without changing the firepower by expensive retrofitting.

With guns outfitted according to the present invention in addition all of the advantages of the well-established tube magazine are retained, and in case of an incident it is possible in seconds to reload with a detachable magazine holding five or eight cartridges, and this reloading can be done again by the use of further standard detachable magazines.

The solution of the instant invention is an evolution of the cartridge feeder of a tube-magazine gun by one degree of freedom. In a first of the two preferred variants the feeder, more particularly the carrier and its drive, is slidable in the receiver so that a front and back movement is possible. In the front latched position the various parts function as usual, that is the cartridges are taken out of the tube magazine and fed to the barrel of the gun. If the movable parts are in the rear latched position, the space is free for a detachable magazine that is latched in place by an appropriate mechanism.

In a second favored variant the above-described parts are held in a frame that itself is used as a detachable magazine. The purpose of this "service magazine" is to pull the cartridges out of the tube magazine and feed them to the barrel of the weapon. As a rule at the start of use of the weapon it is important to be able to handle the gun as normal while picking it up. Once the tube magazine has been emptied, the device according to the invention is ejected as in an automatic pistol by pushing a button and a fully loaded standard detachable magazine is fitted.

Preferred embodiments of the invention are described in the dependent claims.

As a result of the features of claim 12 without any intermediate mechanism cartridges can be taken directly from the detachable magazine. In this manner a standard or only slightly modified detachable magazine can be used.

Embodiments of the invention are shown in vertical sections of details in the drawing and are described more closely in the following. Therein:

Figure 1:
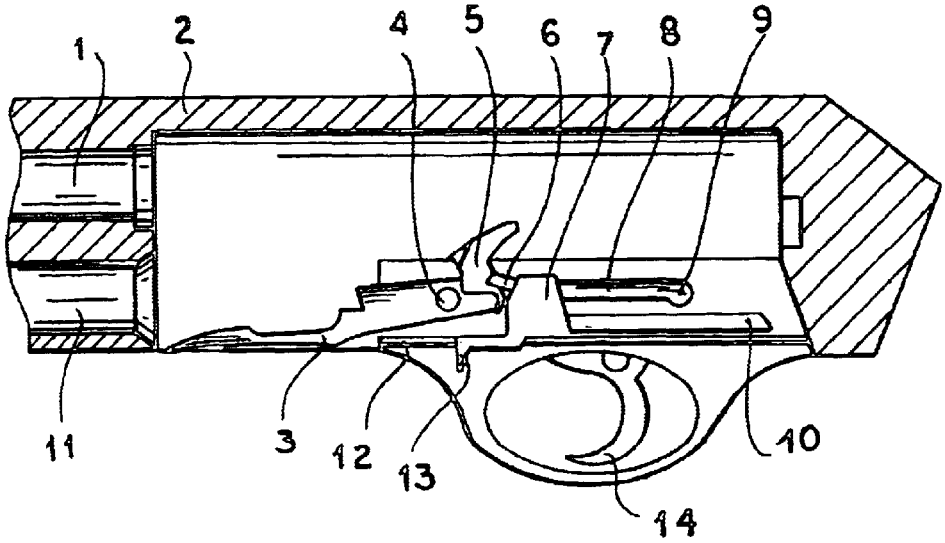
FIG. 1 is the gun without a detachable magazine.
Figure 2:
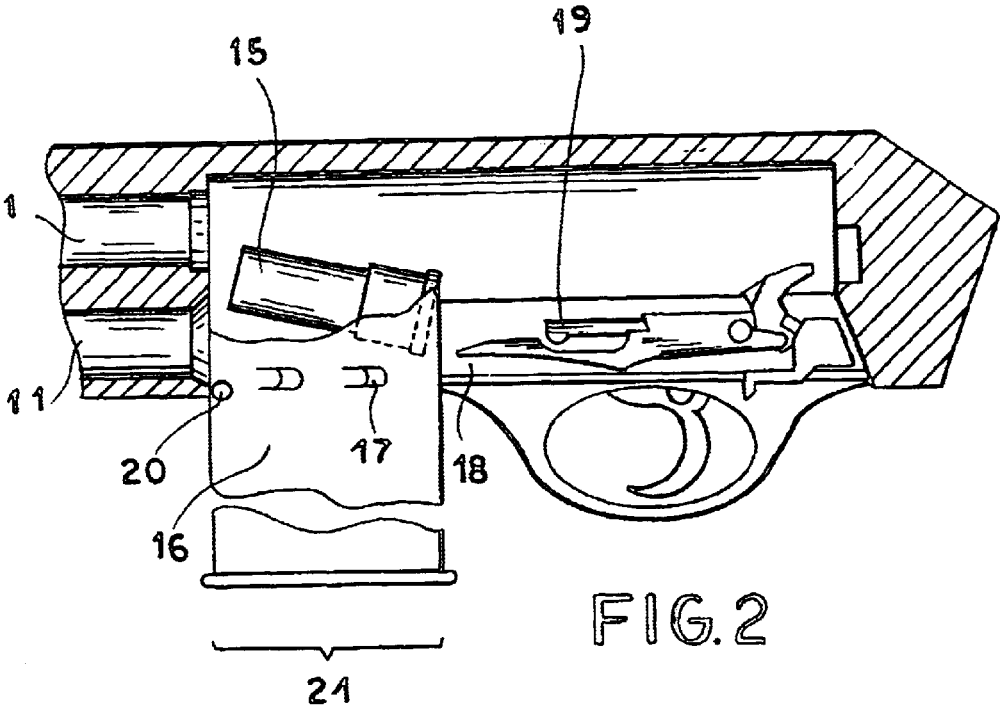
FIG. 2 is the gun with a detachable magazine.
Figure 3:
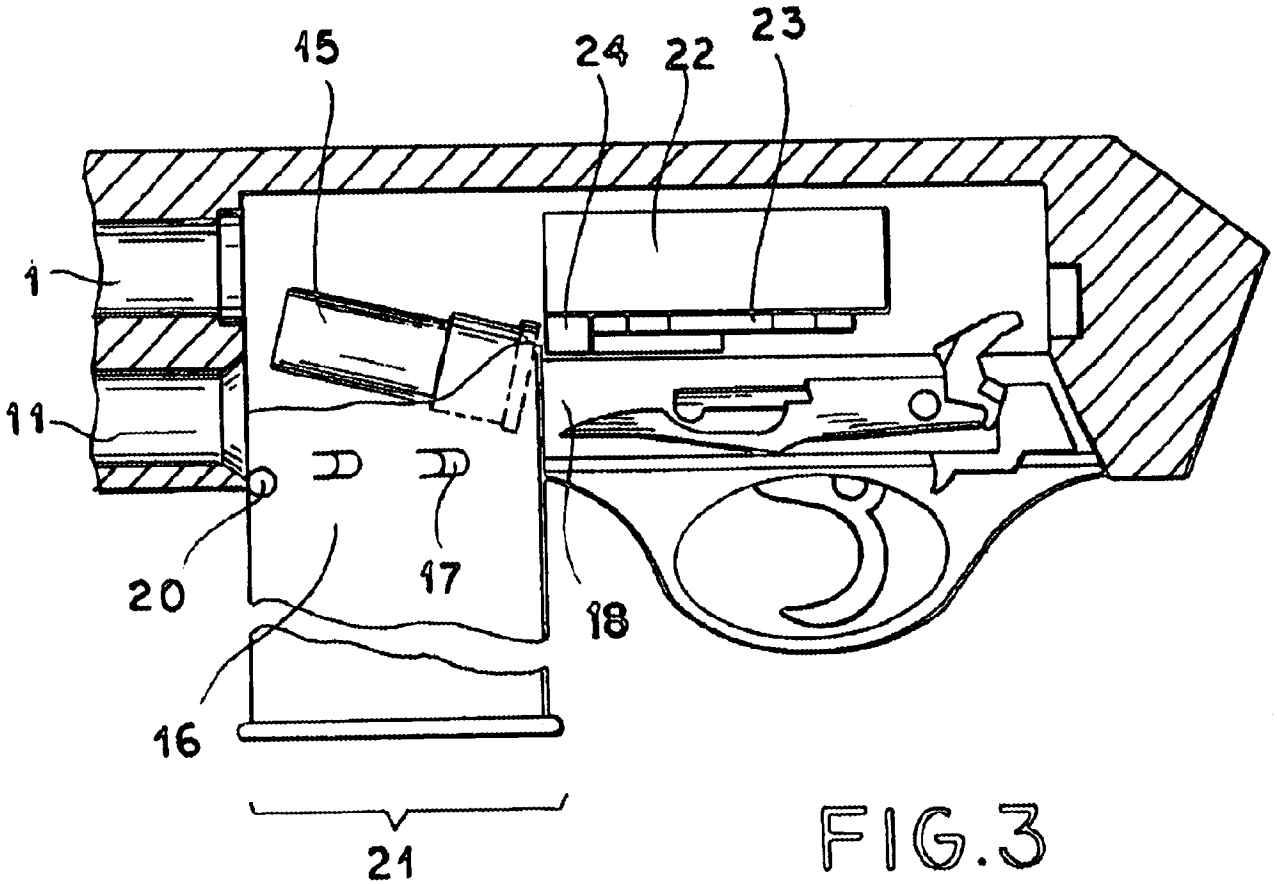
FIG. 3 is the gun with a detachable magazine and breech.

A standard slide-action repeater rifle with a trigger 14 has a closed receiver 2 in which the bolt, ejector, and safety as well as the breech 22 with plate (control block) 23 shown in FIG. 3 for the unillustrated repeating mechanism and the cartridge feeder 3–7. The cartridge feeder has a carrier (spoon) 3 with a pivot pin 4, a drive 4 for the carrier (spoon), a spring 6 for shifting it, and an abutment 7 with a track 10 for the spring. Below the barrel 1 is a tube magazine 11.

In a slide-action repeater, drawing back the action slide opens the breech 22, which extracts the spent shell as it moves back and loads the bolt spring. When the breech 22 reaches its rear-end position, a cartridge 15 is released from the tube magazine 11 and shifted by spring force to the cartridge feeder 3–7.

The forward return movement of the action slide makes the cartridge feeder shift the cartridge 15 to the barrel 1 whereupon the breech 22 slides it home and closes the rear end of barrel 1 toward the bolt. In an autoloading gun, this process is powered by the hot gases or recoil produced by the shot.

If there are no more cartridges 15 in the tube magazine the shooter shifts the cartridge feeder 3, 4, 5, 6, 7 via the actuator 12 along a groove track 8 from the latched front-end position 19 in which the cartridge feeder 3, 4, 5, 6, 7 is effective into a rear latched inactive position 9. To this end the longitudinal groove 8 has at end seats 9 and 19.

In an unillustrated embodiment this step is automatic in that when the last cartridge 15 leaves the tube magazine 11 the actuator 12 is operated by the guide rod of the unillustrated autoloading mechanism.

The receiver 2 is open downward between the tube magazine 11 and the lock plate 13 so that the intervening space 21 can receive a detachable magazine 16 with cutouts 17 (in which the here unillustrated and in this mode functionless guide rod fits), which is held in place by the magazine latch 20 and the guide 18 of the lock plate 13.

The function of the gun is the same as described above. The only difference is that the cartridges 15 are fed by the breech 22 shown in FIG. 3 directly from the detachable magazine 16 to the barrel 1.

It is thus possible to supply the same barrel from different magazines, in particular a tube and a detachable magazine, because the feeder has one more degree of freedom than if it only was used by one type of magazine.

The various needs of the police and sport shooters can be met by various variants of the invention. Thus for example for the police market an embodiment is of particular interest whose feed device retracts into or swings out of the receiver when magazine type changes.

The demands of sport shooters on the other hand are met by an embodiment wherein the feed device for the tube magazine is built as a type of "auxiliary magazine" that can be constructed and used like a detachable magazine and that is described more closely above as the "second favored variant." The sport shooter thus loads the barrel of his gun cartridges either directly from a standard detachable magazine or via the feed device according to the invention from the tube magazine. This embodiment is ideal when used in combination with a modified latch plate as retrofit.

In the embodiment of FIG. 3 the breech 22 longitudinally movable in the receiver (housing) has a lower horizontal plate 23 that can slide on the breech and that actuates a latch as soon as the breech reaches the closed position in which it closes the barrel behind a fresh cartridge. To this end the latch moves into an inner seat or behind an abutment of the receiver so that the breech is blocked against moving back when the cartridge is fired.

The lower side of the breech 22 has a projection 24 in the shape of a longitudinally extending profile that projects downward past the plate 23 and which engages with its front edge against the uppermost cartridge 15 in the detachable magazine 16 when the breech 22 is moved by the action slide forward toward the barrel. In this manner the uppermost cartridge is slid from the detachable magazine into the barrel.

Figure 4:
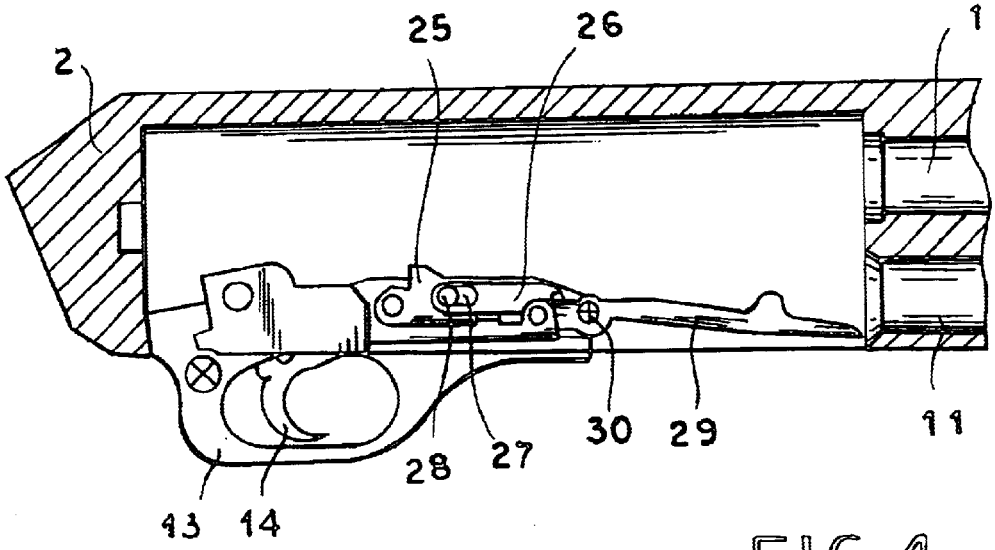
FIG. 4 is the gun with a carrier in a horizontal position for receiving cartridges from a tube magazine.
Figure 5:
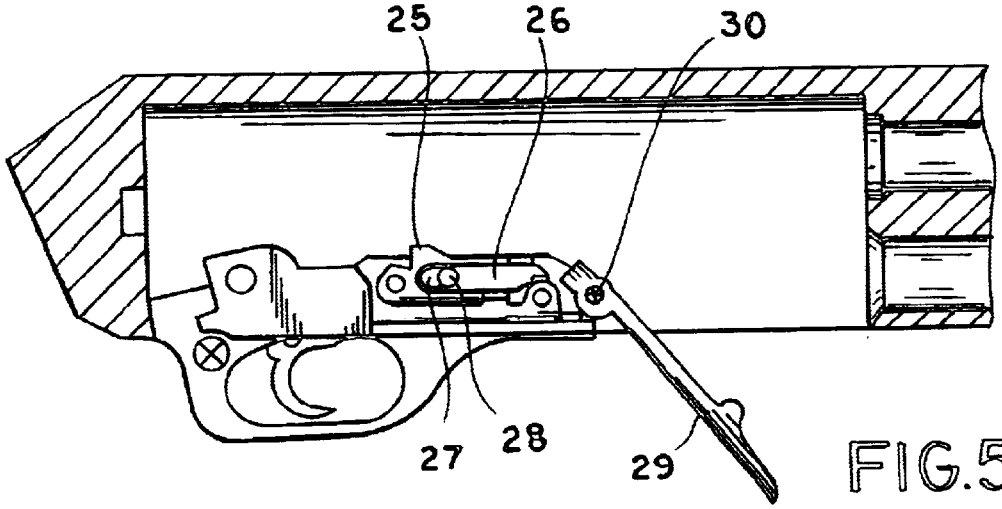
FIG. 5 is the gun with the carrier pivoted halfway down.
Figure 6:
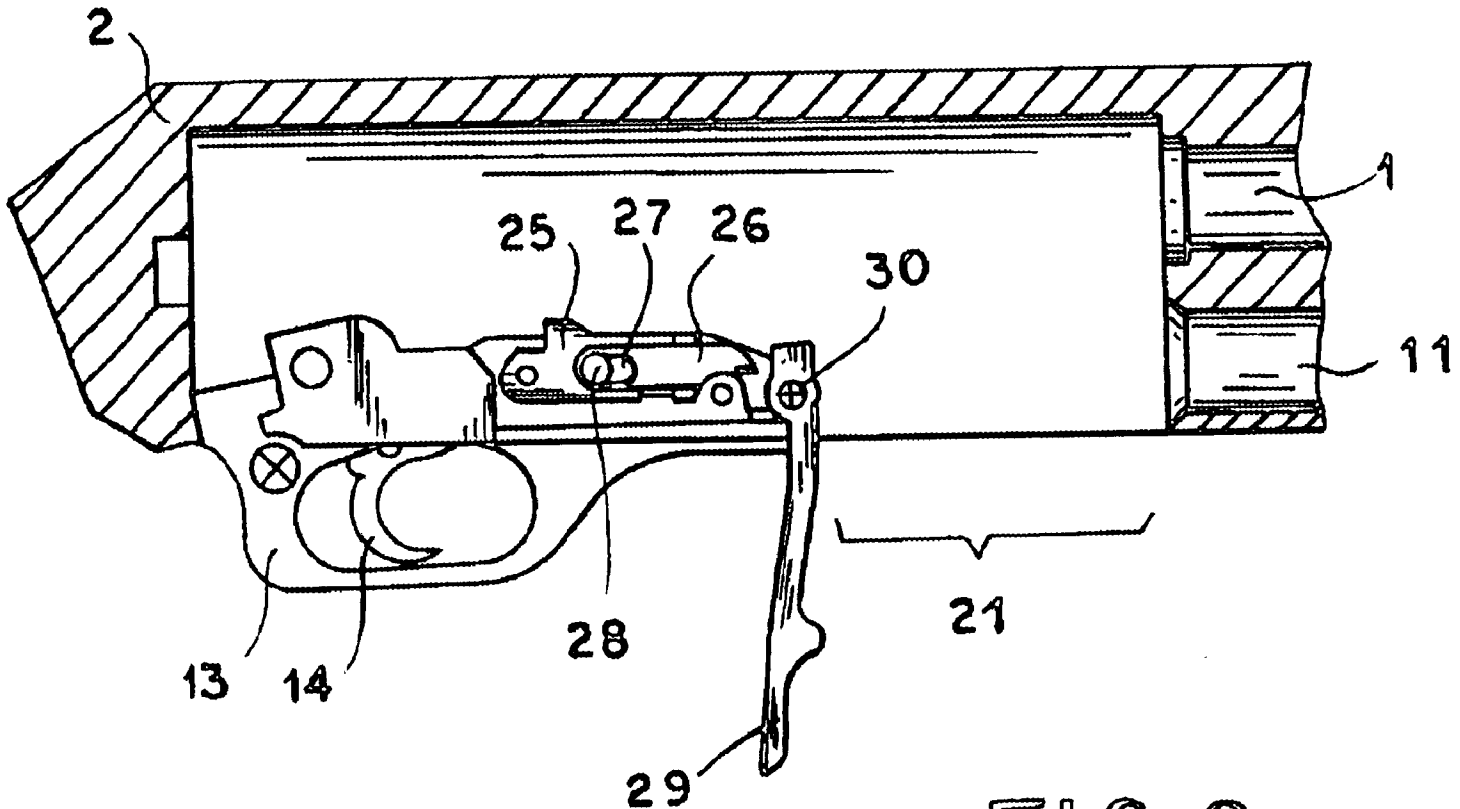
FIG. 6 is the gun with the carrier pivoted into a lower end position so that a detachable magazine can be inserted.

In the embodiment of FIGS. 4 to 6 the carrier is formed of two parts with a back part 25 pivoted on a pin 28 and a front part 29 that projects into the space 21 when it serves to shift the cartridges out of the tube magazine 11 and feed them to the barrel. On the other hand before fitting a detachable magazine 16, the part 29 is swung down and out from the space 21.

Pivotally mounted on the part 25 is a stop (slide 26) by means of which the part 29 can be latched in the horizontal working position.

Parts List

1: barrel
2: receiver
3: carrier
4: pivot for carrier
5: drive for carrier
6: spring for drive 5
7: abutment for spring 6
8: groove track
9: seat for inactive position
10: track for abutment
11: tube magazine
12: actuator
13: lock plate
14: trigger
15: cartridge
16: detachable magazine
17: cutouts
18: guide (on lock plate)
19: seat for front-end position
20: magazine latch for the unillustrated standard magazine holder)
21: space
22: breech
23: plate (control block)
24: cartridge shifter of breech
25: guide part of two-part carrier
26: slide
27: slot in slide
28: pivot for two-part carrier
29: cartridge holding part of two-part carrier
30: axis of the two-part carrier

What is claimed is:

1. In a small firearm having a frame;

a barrel on the frame and having a rear end;

a tube magazine on the frame adapted to hold a plurality of cartridges and having a rear end opening adjacent the rear end of the barrel;

means including a feed mechanism in the frame for moving the cartridges from the rear end of the tube magazine into the rear end of the barrel; and means including a breech mechanism displaceable from a rear position into a forward position for closing the rear end of the barrel and firing a cartridge in the rear end of the barrel, the improvement comprising a detachable magazine adapted to hold a plurality of cartridges;

an opening formed on the frame adjacent the rear end of the tube magazine and adapted to fit with and releasably hold the detachable magazine; and shifting means in the frame for displacing the feed mechanism between a tube-loading position blocking the opening and effective for feeding cartridges from the tube magazine to the barrel and a clip-loading position clear of the opening and allowing the detachable magazine to be fitted to the opening.

2. The firearm defined in claim 1 wherein the shifting means includes a slide and the tube-loading position is forward of the clip-loading position.

3. The firearm defined in claim 2 wherein the slide has a groove extending longitudinally of the tube magazine and barrel and having transversely open end slots in which the feed mechanism can fit.

4. The firearm defined in claim 1 wherein the feed mechanism has a forward cartridge-feeding part, the shifting mechanism including a pivot carrying the cartridge-feeding part for displacement between a position with the cartridge-feeding part extending across the opening toward the tube magazine and a position extending transversely of the barrel and projecting from the frame.

5. The firearm defined in claim 4, further comprising latch means for retaining the part in the position extending across the opening.

6. The firearm defined in claim 1 wherein the detachable magazine is a box magazine.

7. The firearm defined in claim 6 wherein the box magazine holds at least the uppermost cartridge inclined upward with its front end above its rear end.

8. The firearm defined in claim 6 wherein the box magazine holds cartridges inclined upward with their front ends above their rear ends.

9. The firearm defined in claim 1 wherein the breech mechanism has a projection engageable when the feed mechanism is in the clip-feeding position and the detachable magazine is fitted to the opening with an uppermost cartridge in the detachable magazine to slide it into the rear end of the barrel.

* * * * *